US012006694B2

(12) United States Patent
Fitzgerald

(10) Patent No.: US 12,006,694 B2
(45) **Date of Patent: *Jun. 11, 2024**

(54) LOUVER ROOF STRUCTURE

(71) Applicant: ELEVATING IDEAS LLC, SHERIDAN, FL (US)

(72) Inventor: Lisa Fitzgerald, Leesburg, FL (US)

(73) Assignee: ELEVATING IDEAS LLC, Sheridan, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/099,135

(22) Filed: Jan. 19, 2023

(65) Prior Publication Data

US 2023/0212857 A1 Jul. 6, 2023

Related U.S. Application Data

(63) Continuation of application No. 17/895,568, filed on Aug. 25, 2022, now Pat. No. 11,560,718, which is a continuation-in-part of application No. 17/566,791, filed on Dec. 31, 2021, now Pat. No. 11,473,311.

(51) Int. Cl.
*E04F 10/10* (2006.01)

(52) U.S. Cl.
CPC ..... *E04F 10/10* (2013.01)

(58) Field of Classification Search
CPC ..... E04B 7/163; E04D 13/068
See application file for complete search history.

(56) References Cited

U.S. PATENT DOCUMENTS

| | | | |
|---|---|---|---|
| 5,733,036 | A | 3/1998 | Montgomery |
| 8,756,873 | B1 | 6/2014 | Hire |
| 10,851,544 | B1 | 12/2020 | Violin |
| 10,988,926 | B2 | 4/2021 | Mitchell |

(Continued)

FOREIGN PATENT DOCUMENTS

| | | | |
|---|---|---|---|
| CN | 111946104 | A | 11/2020 |
| DE | 102016117772 | A1 | 3/2018 |

(Continued)

OTHER PUBLICATIONS

European Extended Search Report (EESR) for EP 22201794.9 mailed May 2, 2023 (8 pages).

*Primary Examiner* — Beth A Stephan
(74) *Attorney, Agent, or Firm* — Shumaker, Loop & Kendrick, LLP

(57) ABSTRACT

A louver roof system having a simplified assembly and installation methods. The louver roof system is constructed with multi-functional mechanical components by means of pre-molded parts to reduce skilled installation time. Louvers of the roof system each include a louver body defining an integrally formed channel configured to direct water internally from the louver body, through the integrally formed channel of the respective louver, within a frame, and out of the louver roof system when the louvers are in a closed position. The louver body of each of the louvers includes a top surface with an uppermost portion of the top surface that defines, when in the closed position, a non-perpendicular angle relative to the vertical direction such that water is directed to the integrally formed channel of the respective louver Thus, a water drainage path is an integral part of the main structural assembly.

17 Claims, 12 Drawing Sheets

(56) References Cited

U.S. PATENT DOCUMENTS

| | | | | |
|---|---|---|---|---|
| 11,473,311 | B1 * | 10/2022 | Fitzgerald | E04F 10/10 |
| 11,560,718 | B1 * | 1/2023 | Fitzgerald | E04F 10/10 |
| 2019/0338528 | A1 | 11/2019 | Torman et al. | |
| 2020/0354962 | A1 | 11/2020 | Whytlaw | |
| 2020/0370299 | A1 | 11/2020 | Shan et al. | |
| 2021/0010270 | A1 * | 1/2021 | Zhao | E04B 1/163 |
| 2021/0062505 | A1 | 3/2021 | Elmore | |
| 2021/0214948 | A1 | 7/2021 | Jackson | |
| 2021/0332587 | A1 | 10/2021 | Geriavenko et al. | |

FOREIGN PATENT DOCUMENTS

| | | | |
|---|---|---|---|
| DE | 202021000335 | U1 | 3/2021 |
| DE | 202021102781 | U1 | 10/2021 |
| FR | 2947845 | A1 | 1/2011 |

* cited by examiner

27

LOUVER ROOF STRUCTURE

TECHNICAL FIELD

The present invention relates generally to the field of patio roofs, and more particularly, to easy to assemble and disassemble freestanding louver roofs.

BACKGROUND

Louver roofs have been commercially available for many years. These roofs are typically used on patios or outside event areas to allow sunlight on clear days and dryness on rainy days. This is accomplished by moving the louvers from an open to shut position manually or motor-driven by means of sensors and/or control panel switches. These lover roofs are constructed from a plurality of rotatable louvers, linked together by mechanical links and hinges that require skilled workers to install in the field. Alignment of these parts are critical to the reliability and longevity of the louvers' ability to move freely from the open to closed position. The assembly of super structure that houses and supports the lovers are also critical to the smooth mechanical action of the assembly. Water sealing and water removal from the structure is also challenging with the multitude of parts requiring skilled and experienced installers.

SUMMARY

Thus, a need exists to provide an easier installation alternative that overcomes the above-mentioned problems. Thus, specifically disclosed is a louver roof system that provides easier field installation and mechanical construction that uses low tolerance assembles with fewer parts.

The louver drive system is comprised of one single cable to move the louvers from an open to closed position, thereby eliminating linkages and hinges used on current designs. In this embodiment, the cable is actuated by means of a linear actuator. In other embodiments, the cable can be actuated by a rotational actuator (motor pulley) or a hand crank. The cable is wrapped around a drum, an integral part of the plastic end cap. This end cap is molded with weather-resistant plastic, one for each end of each louver. The cable is routed to the drive module, located in one of the structural posts, through cable sheaths similar to a bicycle brake cable. This drive module contains the linear actuator to drive the cable, thereby opening or closing the louvers. To assemble, the cable is tensioned for the entire assembly. The louvers are manually positioned to the correct position and locked into place, relative to the cable, by means of a clamping screw located on each louver end cap, thereby eliminating precision parts and critical installation techniques used on current designs.

In this embodiment, the main structure is composed of four posts, in a rectangular pattern, connected at the top by four beams. In other embodiments there may be two posts on one side and on the other side, beams attached to an existing structure. These beams provide the load-bearing structure for the roof louvers. The louvers are connected to the beams by hangers on each end of the louver assemblies. These hangers are molded with a weather resistant plastic. The hanger uses a cup-and-ball type bearing arrangement. The cup is an integral part of the hanger, and the ball is part of the louver end-cap assembly. This allows large alignment tolerance in this bearing, which provides easier installation of the louvers to the main structure. In this embodiment, the louvers are level to the ground plane. In other embodiments, the entire roof assembly may be at an angle, for water flow and/or aesthetics, relative to the ground plane. In this case, the bearing arrangement allows this angle to be achieved while all the main structure components are parallel to the ground.

Drainage is provided using a gutter, as an integral part of the beam extrusion, to channel water to the interior volume of the posts, thereby using the post as downspouts. Louver assemblies have drainage channels that empty into the beam gutters. A splash guard, an integral part of each louver end cap, prevents slash-back as water enters the beam gutters. An opening at ground level on the post allowing water to escape. An aluminum cover is attached to the top of the beams to keep leaves and debris out of the beam gutters. This cover also acts as a UV blocker to increase the life of the molded plastic parts in the assembly.

Control of louver actuation is provided by switches on a control panel and/or remote radio control that provides power to the linear actuator. An "H" bridge switch allows the linear actuator to run in two directions, dependent on the switch activated by the user. All control circuits are integrated in one control module located in the drive module.

In certain aspects, disclosed is a louver roof structure that comprises: (a) a plurality of louvers positioned within an upper portion of a frame and that are actuatable from an open position to a closed position, the plurality of louvers forms a plurality of channels configured to direct water internally within the frame and out of the louver roof structure when the plurality of louvers are in the closed position; and the frame including: vertically oriented posts, with each post having a first end and second end that are spaced apart from one another with the first end configured to directly contact a surface underneath the louver roof structure and support the louver roof structure thereon, a plurality of crossbeams, with at least one cross beam positioned between and directly connected to the second end of two vertically oriented posts, wherein: the frame includes internal portions configured to receive water from the plurality of channels formed by the plurality of louvers when in the closed position and direct water internally within the louver roof structure through at least one crossbeam of the frame internally into at least one vertically oriented post of the frame and out of the louver roof structure via an opening positioned on the first end of the at least one vertically oriented post.

In certain aspects, the louver roof structure further comprises a debris cover positioned above the upper portion of the frame that is configured to prevent and/or reduce debris from entering into the plurality of louvers to maintain operability of the plurality of louvers.

In certain aspects, each louver of the plurality of louvers is connected to one another and configured to actuate in concert from the open position to the closed position and vice versa.

In certain aspects, each louver of the plurality of louvers includes a drum that is operably connected to a cable and an actuator.

In certain aspects, the actuator is configured to actuate the cable thereby concurrently moving each louver of the plurality of louvers from the open position to the closed position and vice versa.

In certain aspects, the actuator is internally positioned and concealed within at least one of the vertically oriented posts.

In certain aspects, each crossbeam of the frame and each vertically oriented post of the frame includes portions internally positioned within the louver roof structure that are configured to receive water from the plurality of channels formed by the plurality of louvers when in the closed position that direct water internally within the louver roof structure through at least one crossbeam of the frame internally into at least one vertically oriented post of the frame and out of the louver roof structure via an opening positioned on the first end of the at least one vertically oriented post.

In certain aspects, each crossbeam comprises a gutter formed internally within the louver roof structure on an inner portion of the crossbeam that is configured to receive water from the plurality of channels formed by the plurality of louvers when in a closed position and each vertically oriented post comprises a downspout that is in fluid communication with at least one gutter formed on the inner portion of at least one of the crossbeam and is configured to direct water through the vertically oriented posts and out of openings positioned on the first end of each vertically oriented post.

In certain aspects, the louver roof structure includes at least two gutters formed internally within the louver roof structure on an inner portion of two separate crossbeams and the louver roof structure further includes at least two downspouts, with each downspout formed in two separate vertically oriented posts. In this aspect, the at least two gutters are in fluid communication with at least one of the two downspouts to direct water from the water channels formed in the closed louvers into the downspouts and out of the louver roof structure.

In certain aspects, the louver roof structure includes at least four gutters formed internally within the louver roof structure on an inner portion of four separate crossbeams and the louver roof structure further includes at least two downspouts, with each downspout formed in two separate vertically oriented posts. In this aspect, the at least four gutters are in fluid communication with at least one of the two downspouts to direct water from the water channels formed in the closed louvers into the downspouts and out of the louver roof structure. In certain aspects, the louver roof structure includes at least three gutters formed internally within the louver roof structure on an inner portion of two separate crossbeams and the louver roof structure further includes at least three downspouts, with each downspout formed in three separate vertically oriented posts. In this aspect, the at least three gutters are in fluid communication with at least one of the three downspouts to direct water from the water channels formed in the closed louvers into the downspouts and out of the louver roof structure. In certain aspects, the louver roof structure includes at least four gutters formed internally within the louver roof structure on an inner portion of four separate crossbeams and the louver roof structure further includes at least four downspouts, with each downspout formed in four separate vertically oriented posts. In this aspect, the at least four gutters are in fluid communication with at least one of the four downspouts to direct water from the water channels formed in the closed louvers into the downspouts and out of the louver roof structure. In any of the aspects above, it is preferable that an opening (or aperture) be positioned within the first end of any vertically oriented post having a downspout therein to further facilitate water flow out and away from the louver roof structure.

In certain aspects, the louver roof structure further comprises connecting members that connect each louver to the frame that are configured for independent linear movement of each louver relative to one another during and post-installation of the louver roof structure.

In certain aspects, the connecting members comprises a cup and ball bearing arrangement.

In certain aspects, the connecting members do not allow for independent rotational movement of each louver relative to one another.

In certain aspects, the internal portions are configured to receive water comprise a gutter formed on an inner portion of the at least one crossbeam and a downspout formed within the at least one vertically oriented post that is in fluid communication with both the gutter formed on an inner portion of the at least one crossbeam and the opening positioned on the first end of the at least one vertically oriented post. In certain aspects, the louver roof structure further comprises connecting members that connect each louver to the frame that are configured for independent linear movement of each louver relative to one another during and post-installation of the louver roof structure.

Also disclosed is a louver roof assembly comprising: (a) a plurality of louvers configured for positioning within an upper portion of a frame that are actuatable from an open position to a closed position, the plurality of louvers form a plurality of channels are configured to direct water internally within the frame and out of the louver roof structure when the plurality of louvers are in the closed position; and (b) the frame including: (i) vertically oriented posts, with each post having a first end and second end that are spaced apart from one another with the first end configured to directly contact a surface underneath the louver roof structure and support the louver roof structure thereon, (ii) a plurality of crossbeams, with each cross beam configured for positioning between and directly connected to the second end of two vertically oriented posts, wherein: the frame includes internal portions configured to receive water from the plurality of channels formed by the plurality of louvers when in the closed position and direct water through at least one crossbeam of the frame internally into at least one vertically oriented post of the frame and out of the louver roof structure via an opening positioned on the first end of the at least one vertically oriented post.

In certain aspects, the louver roof assembly further comprises a debris cover that is configured for positioning above the upper portion of the frame to prevent and/or reduce debris from entering into the plurality of louvers to maintain operability of the plurality of louvers when the louver roof assembly is assembled. In this aspect, each louver of the plurality louvers is connected to one another and are configured to actuate in concert from an open position to the closed position and vice versa. In this aspect, the internal portions are configured to receive water comprise a gutter formed on an inner portion of the at least one crossbeam and a downspout formed within the at least one vertically oriented post that is in fluid communication with both the gutter formed on an inner portion of the at least one crossbeam and the opening positioned on the first end of the at least one vertically oriented post.

In certain aspects, the louver roof assembly further comprises connecting members configured to connect each louver to the frame and for independent linear movement of each louver relative to one another during and post-installation of the louver roof structure. In certain aspects, the connecting members comprises a cup and ball bearing arrangement.

In another aspect, the present disclosure is directed to a louver roof structure including a plurality of louvers positioned within an upper portion of a frame and that are actuatable from an open position to a closed position. Each louver of the plurality of louvers includes a louver body defining an integrally formed channel configured to direct water internally from the louver body, through the integrally formed channel of the respective louver, within the frame, and out of the louver roof structure when the plurality of louvers are in the closed position. The louver roof structure also includes a frame having vertically oriented posts. Each of the vertically oriented posts has a first end and a second end that are spaced apart from one another with the first end configured to directly contact a surface underneath the louver roof structure and support the louver roof structure thereon. The frame further includes a plurality of crossbeams. At least one of the crossbeams is positioned between and directly connected to the second end of two of the vertically oriented posts. The louver body of each of the louvers includes a top surface with an uppermost portion of the top surface that defines, when in the closed position, a non-perpendicular angle relative to the vertical direction such that water is directed to the integrally formed channel of the respective louver. The frame includes internal portions configured to receive water from the plurality of channels formed by the plurality of louvers when in the closed position and direct water internally within the louver roof structure through at least one of the crossbeams of the frame internally into at least one of the vertically oriented posts of the frame and out of the louver roof structure via an opening positioned on the first end of the at least one vertically oriented post.

In at least one embodiment, the uppermost portion of the top surface of the louver body of each of the louvers may extend from a first end to a second end between a first edge and channel edge, along which the integrally formed channel extends. In some embodiments, the first edge may be positioned higher in the vertical direction than the channel edge in the closed position such that the louver body defines the non-perpendicular angle. In an additional or alternative embodiment, the uppermost portion of the top surface of the louver body of each of the louvers may define, when in the closed position, a convex shape relative to the vertical direction from the first edge to the channel edge in cross-section. Additionally or alternatively, the uppermost portion of the top surface of the louver body of each of the louvers may be a semi-cylindrical shape, when viewed in cross-section, and extend along a longitudinal direction from a first end to a second end and extends along spanwise direction from a first edge to a channel edge. In some embodiment, an apex of the semi-cylindrical shaped uppermost portion of top surface defined by the louver body of each of the louvers may be positioned mid-span between the first edge and the second edge. In additional or alternative embodiment, the uppermost portion of the top surface of the louver body of each of the louvers may define a variable slope from the first edge to the channel edge in cross-section. In some embodiment, the louver body of each of the louvers may further include an inner channel wall extending longitudinally along the channel edge of the respective louver body. The inner channel wall may be configured to extend, when in the closed position, along the vertical direction between the channel edge and a bottom of the integrally formed channel of the respective louver body. In some embodiments, the inner channel wall may be further configured to extend, when in the closed position, along the vertical direction from the channel edge to a bottom of the integrally formed channel of the respective louver body.

In additional or alternative embodiments, a vertical distance between the first edge and the channel edge of the uppermost portion of the top surface of the louver body of each of the louvers may define a first height difference, when in the closed position. Furthermore and in the open position, the vertical distance between the first edge and the channel edge of the top surface of the louver body of each of the louvers may define a second height difference, and the second height difference may greater than the first height difference. Additionally or alternatively, the louver body of each of the louvers may define an arc between the first end and the second end. In some embodiments, the louver body of each of the louvers may define an arc from the first end of the louver to the second end.

In additional or alternative embodiments, each louver of the plurality of louvers may include a cable drum coupled to the first end. In further or alternative embodiments, each of the louvers may further include an end cap integrally formed with the cable drum. Additionally or alternatively, each louvers may further include an additional cable drum coupled to the second end. In some such embodiments, each of the louvers may further include an additional end cap integrally formed with the additional cable drum. In an additional or alternative embodiment, the frame may further include a vertically oriented splash shield affixed to one of the crossbeams and extending along the longitudinal axis of a first sequential louver of the plurality of louvers. The vertically oriented splash shield and the first sequential louver may be configured to selectively produce a seal therebetween when the first sequential louver is in the closed position.

In an additional or alternative aspect, the present disclosure is directed to a louver roof structure assembly including a plurality of louvers configured for positioning within an upper portion of a frame that are actuatable from an open position to a closed position. The plurality of louvers form a plurality of channels configured to direct water internally within the frame and out of the louver roof structure when the plurality of louvers are in the closed position. The frame includes vertically oriented posts, and each of the vertically oriented post has a first end and a second end that are spaced apart from one another. The first end is configured to directly contact a surface underneath the louver roof structure and support the louver roof structure thereon. A plurality of crossbeams of the frame are each configured for positioning between and directly connected to the second end of two vertically oriented posts. The frame further includes a vertically oriented splash shield affixed to one of the crossbeams and extending along a longitudinal axis of a first sequential louver of the plurality of louvers. The vertically oriented splash shield and the first sequential louver are configured to selectively produce a seal therebetween when the first sequential louver is in the closed position. Furthermore, the frame includes internal portions configured to receive water from the plurality of channels formed by the plurality of louvers when in the closed position and direct water internally within the louver roof structure through at least one of the crossbeams of the frame internally into at least one of the vertically oriented posts of the frame and out of the louver roof structure via an opening positioned on the first end of the at least one vertically oriented post.

In an additional or alternative embodiment, the frame may also include an additional vertically oriented splash shield affixed to another one of the crossbeams and extending along a longitudinal axis of a last sequential louver of the plurality of louvers. The additional vertically oriented splash shield and the last sequential louver may be configured to selectively produce an additional seal therebetween when the last sequential louver is in the closed position. In further or alternative embodiments, the vertically oriented splash shield may extend along the longitudinal direction of the first sequential louver of the plurality of louvers and from a first end of the vertically oriented splash shield to a second end. In some embodiments, the vertically oriented splash shield may define an arc between the first end and the second end. In additional or alternative embodiments, the vertically oriented splash shield and the first sequential louver may be configured to selectively produce the seal therebetween along an entire length of the arc defined by first sequential louver.

Additional features, aspects and advantages of the invention will be set forth in the detailed description that follows, and in part will be readily apparent to those skilled in the art from that description or recognized by practicing the invention as described herein. It should be understood that both the foregoing general description and the following detailed description present various embodiments of the invention and are intended to provide an overview or framework for understanding the nature and character of the invention as it is claimed. The accompanying drawings are included to provide a further understanding of the invention, are incorporated in, and constitute a part of this specification.

BRIEF DESCRIPTION OF THE DRAWINGS

A full and enabling disclosure of the present invention, including the best mode thereof, directed to one of ordinary skill in the art, is set forth in the specification, which makes reference to companying drawings. Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. In the drawings.

Like reference numerals in the drawings may represent and refer to the same, analogous, or similar elements, features, or functions.

DETAILED DESCRIPTION

Embodiments of the present invention will now be described more fully, hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use and practice the invention. Like reference numbers refer to like elements throughout the various drawings. Unless defined otherwise, technical and scientific terms used herein have the same meaning as commonly understood to one of ordinary skill in the art to which the presently disclosed subject matter pertains.

Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Unless described or implied as exclusive alternatives, features throughout the drawings and descriptions should be taken as cumulative, such that features expressly associated with some particular embodiments can be combined with other embodiments. It is envisioned that other embodiments may perform similar functions and/or achieve similar results. Any and all such equivalent embodiments and examples are within the scope of the present invention and are intended to be covered by the appended claims.

The terms "coupled," "fixed," "attached to," and the like refer to both direct coupling, fixing, or attaching, as well as indirect coupling, fixing, or attaching through one or more intermediate components or features, unless otherwise specified herein.

The exemplary embodiments are provided so that this disclosure will be both thorough and complete and will fully convey the scope of the invention and enable one of ordinary skill in the art to make, use and practice the invention. The louver roofs, louver roof structures, and louver roof structures disclosed herein may vary in size and dimension but are preferably used for outdoor purposes (e.g., patios).

Figure 1:
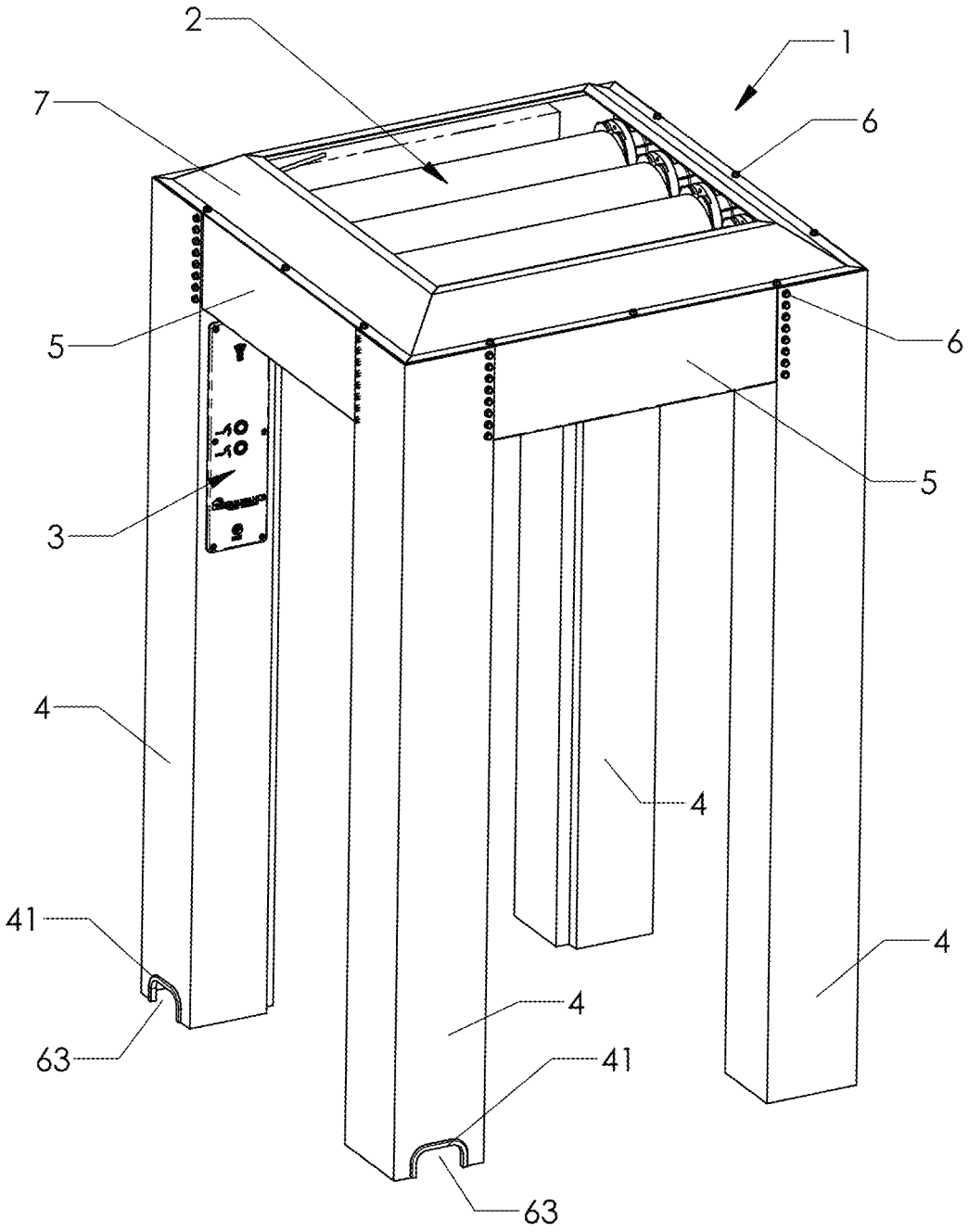
FIG. 1 is an Isometric view of the louver roof assemblies.
Figure 2:
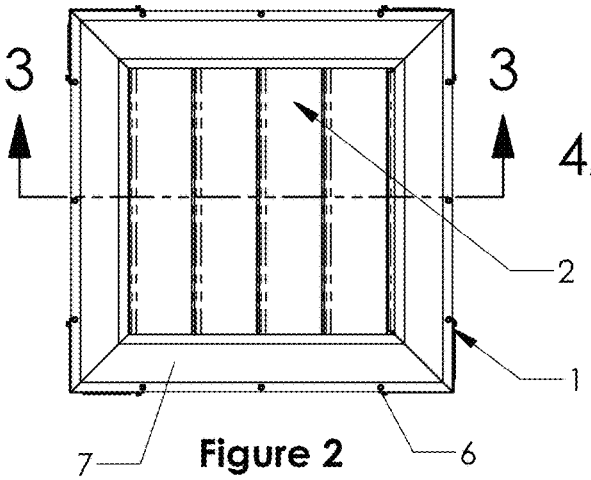
FIG. 2 is a Top view of the louver roof assemblies.
Figure 3:
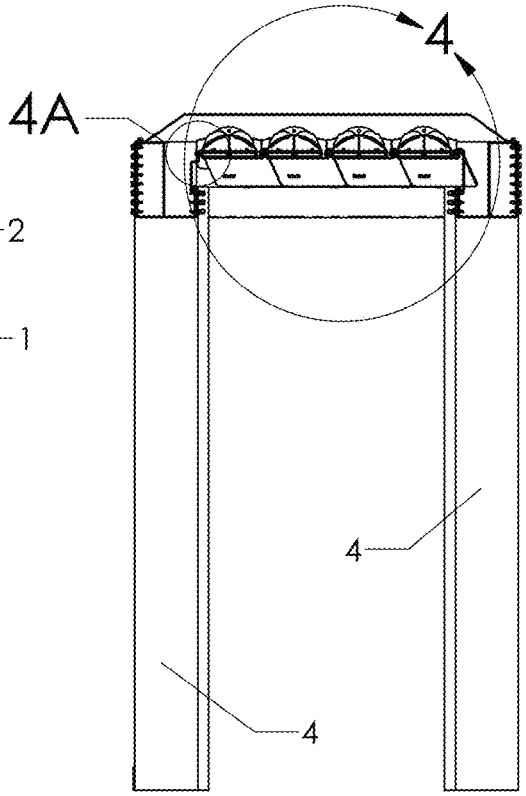
FIG. 3 is a Section view of FIG. 2.
Figure 4A:
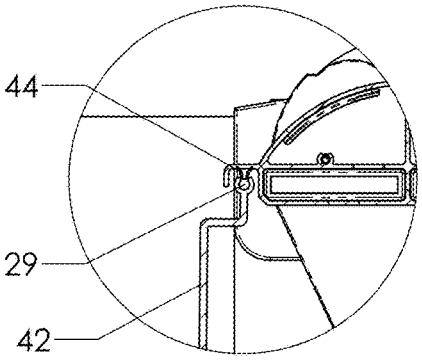
FIG. 4A is another magnified Detail View of FIG. 3.
Figure 4:
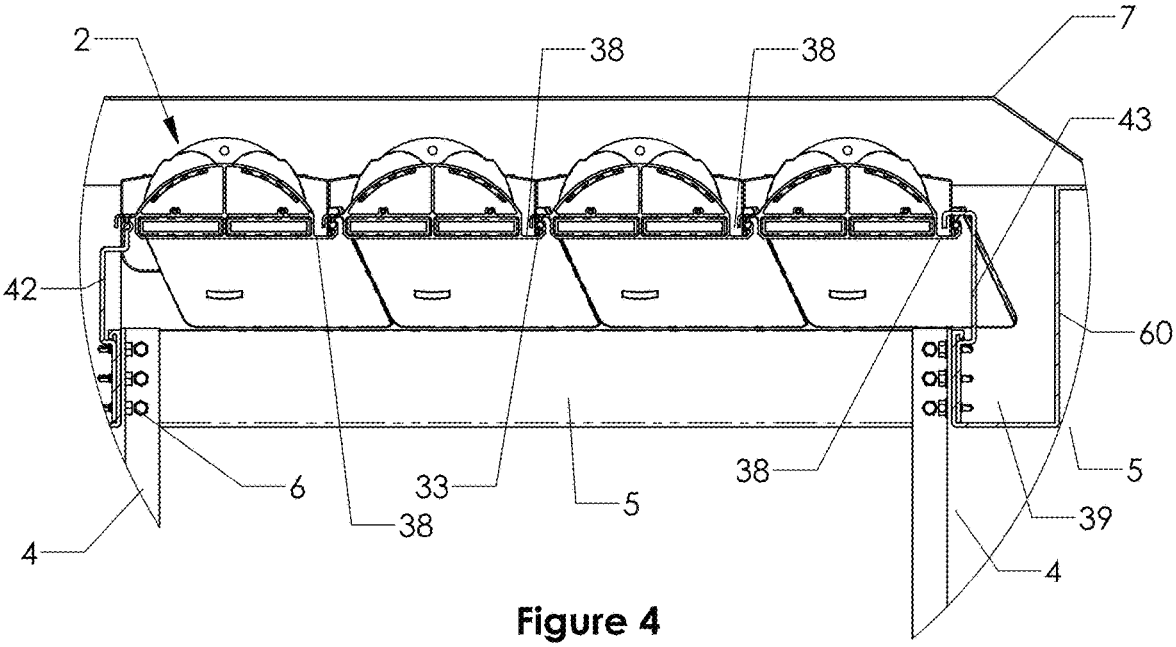
FIG. 4 is a magnified Detail View of FIG. 3.
Figure 5:
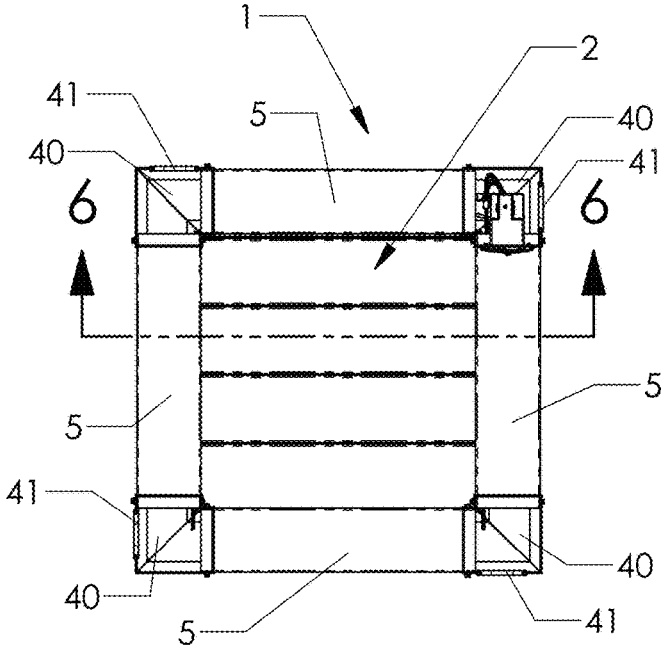
FIG. 5 is a Bottom view of the louver roof assemblies.
Figure 6:
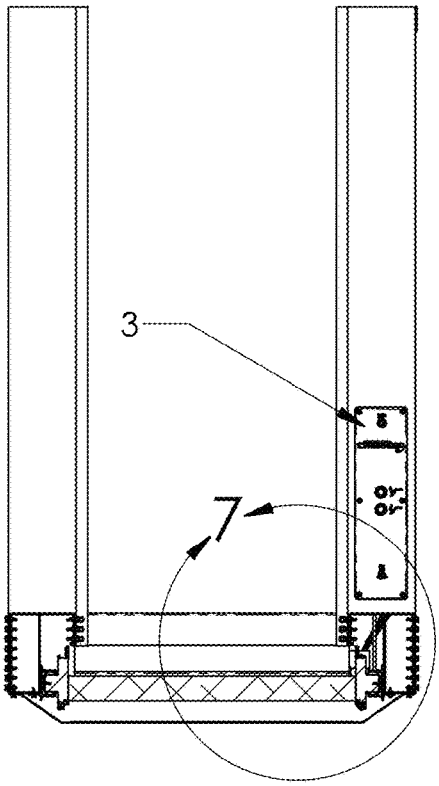
FIG. 6 is a Section view of FIG. 5.

Referring to FIG. 1 the louver roof is comprised of the main structure 1, a plurality of louver assemblies 2 and drive module assembly 3.

Referring to FIGS. 1, 2, 3, 4, 5, 6, 7, 27, 28, 29, 30 and 31, main structure 1 is comprised of 4 (four) posts 4, constructed from aluminum extrusions, arranged vertically in a rectangular pattern, and 4 (four) beams 5, constructed from aluminum extrusions, located coincident to the top surface of the posts. The 4 (four) posts 4 are attached to the 4 (four) horizontal beams 5 by means of a plurality of self-tapping screws 6. This forms a rigid box structure if lower posts are connected to a ground substrate. One of the posts 4 provides the mounting substrate for the drive module 3. The top surface of the 4 (four) beams 5 provide surface for mounting for the 4 (four) debris/UV covers 7 by means of a plurality of self-tapping screws 6. These covers are installed to keep leaves and debris out of the louver mechanism and provide UV shielding for plastic parts used in the assembly.

Referring to FIGS. 1, 2, 3, 4, 5, 6, 7 and 26, beam 5 provides the structural mounting surface for a plurality of louver assemblies 2 by means of hangers 9 secured by self-tapping screws 6. Beam 5 is the lateral rectangular structural member formed by structural wall 60, an integral part of the beam 5 extrusion. An appendage on beam 5 creates gutter 39 to channel water from the louver assemblies 2, by means of water channel 38, to the downspout 40, the internal volume of the post 4. The gutter 39 appendage adds additional beam strength to beam 5. A decorative bezel 41 is captured in an aperture 63 on each post 4 at ground level. These apertures 63 drain the downspouts 40.

Referring to FIGS. 4, 10, 11, 12, 13, 14, and 15, louver assembly 2 is comprised of the louver body 32, an aluminum extrusion, left louver cap 25, a molded plastic part, and right louver cap 26, a molded plastic part. The louver caps are affixed to the louver body 32 by means of thread-forming screws 30. Bearing 8 is attached to bearing boss 36 of each end cap by means of screw 31. A clamp screw 14 and clamp screw nut 15 is installed in the right end cap 26. In other embodiments, these screws may be installed in the left end cap 25. A water channel 38, an integral part of louver body 32, runs along the longitudinal axis of louver body 32 to drain water through the left end cap 25 and right end cap 26 and into gutter 39, an integral part of beam 5. As shown and in some embodiments, the louver body 32 is configured to direct all or substantially all of any rain water that falls on the respective louver to the water channel 38 of that same louver body 32 (rather than, for example, a drainage channel or passage of an adjacent longitudinally extending structure, louver, or the like). In various embodiments, the louver body 32 of each louver may include a top surface, e.g., an uppermost portion of the top surface of the louver body 32, that extends from a first end to a second end of the louver body 32 and between a first edge (e.g., an edge including sealing channel 37 configured and/or arranged to produce a seal against an adjacent louver when the louvers are in the closed position) and a channel edge (e.g., an edge along which the integrally formed water channel 38 extends). Left and right end caps include a splashguard 35, an integral part of each end cap. Louver seal 33, an elastomer extrusion, is press fit into the louver seal channel 34, an integral part of louver body 32. This seal runs along the longitudinal axis of louver body 32 and seals against sealing channel 37 on the adjacent louver when louvers are in the closed position.

Figure 7:
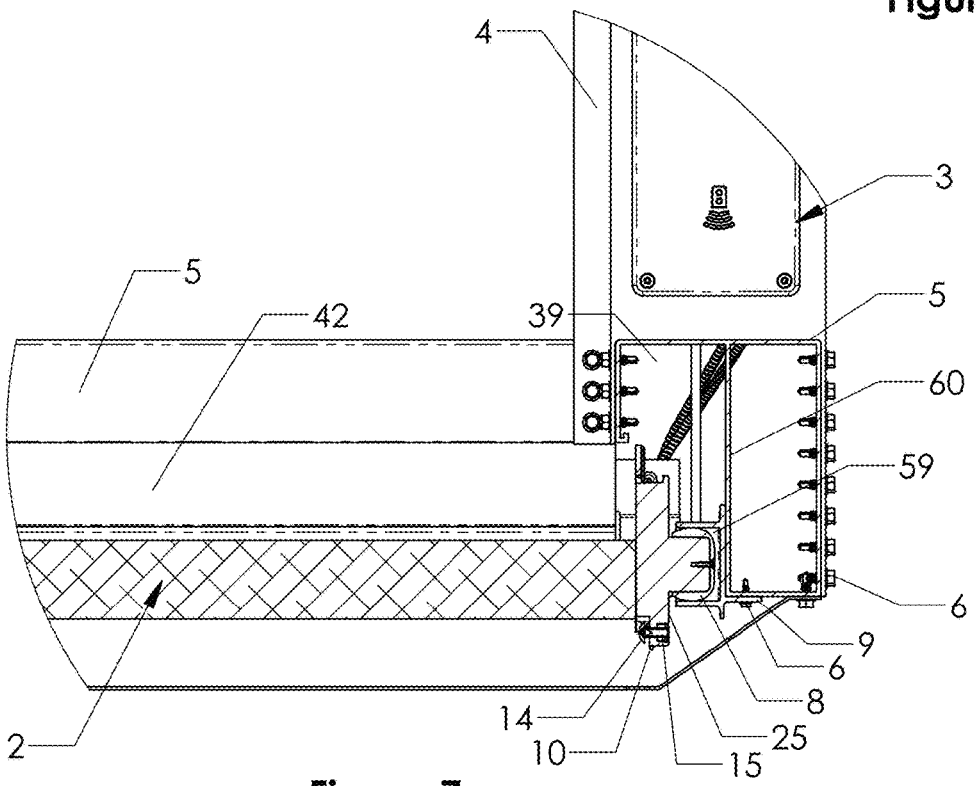
FIG. 7 is a magnified Detail view of FIG. 6.
Figure 17:
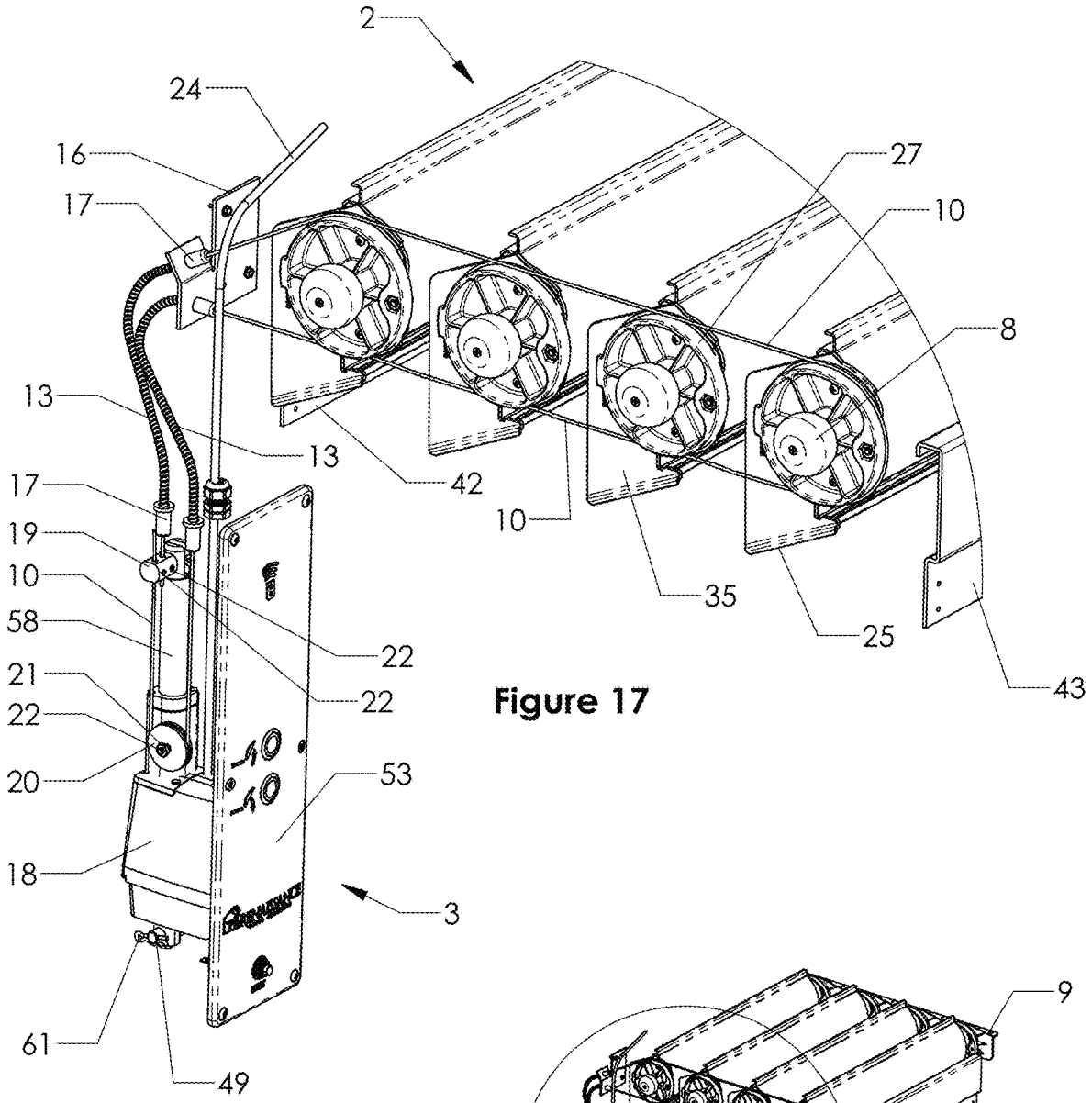
FIG. 17 is a magnified Detail view of FIG. 16.
Figure 16:
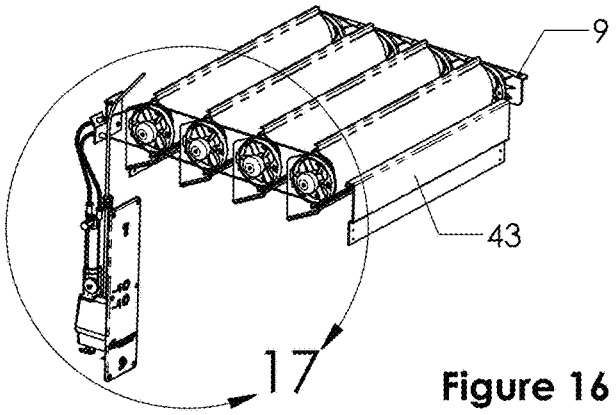
FIG. 16 is another Isometric view of the louver roof assemblies with parts removed for clarity.
Figure 18:
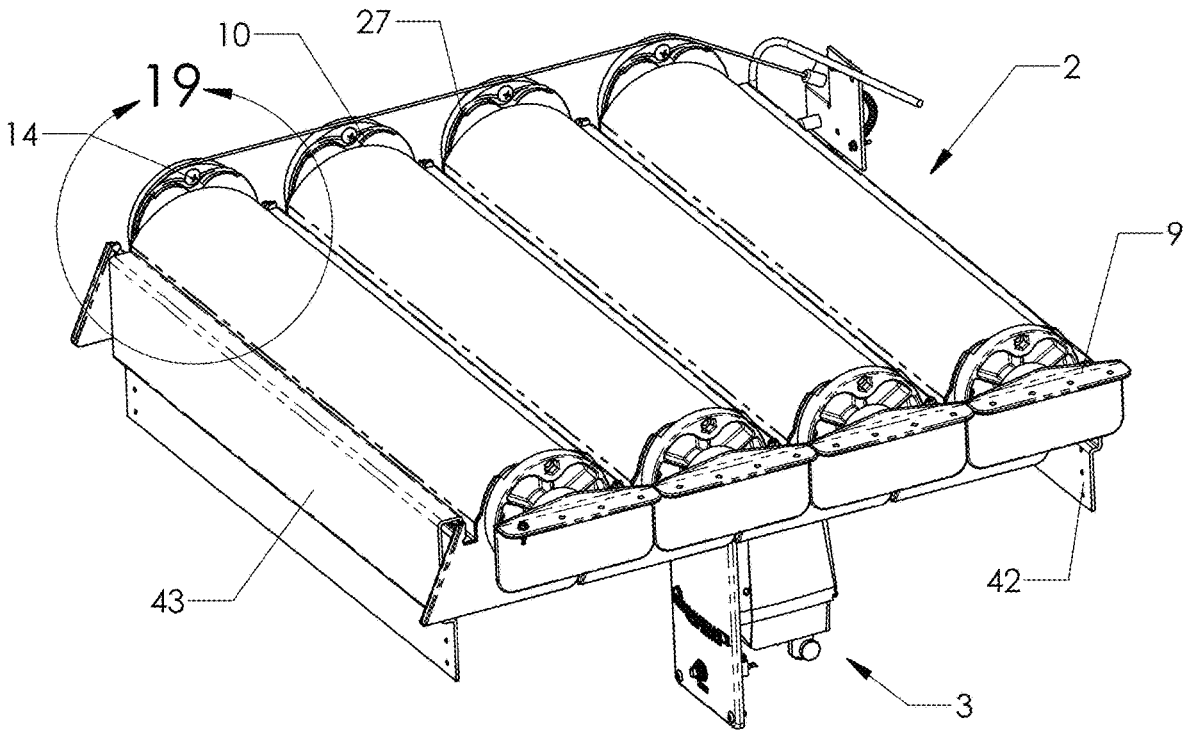
FIG. 18 is another Isometric view of the louver roof assemblies with parts removed for clarity.
Figure 19:
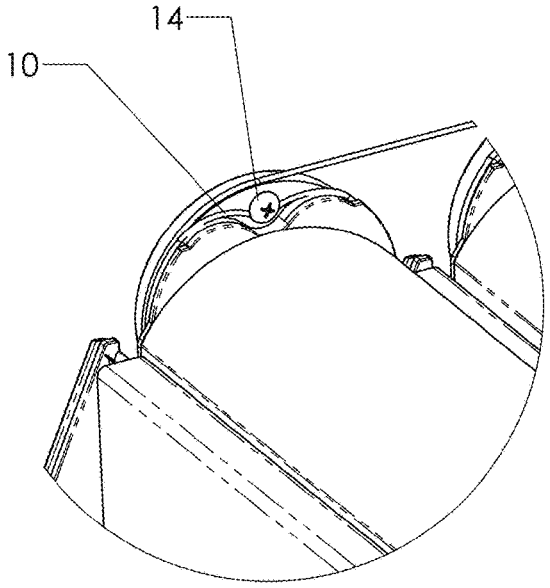
FIG. 19 is a magnified Detail view of FIG. 18.
Figure 20:
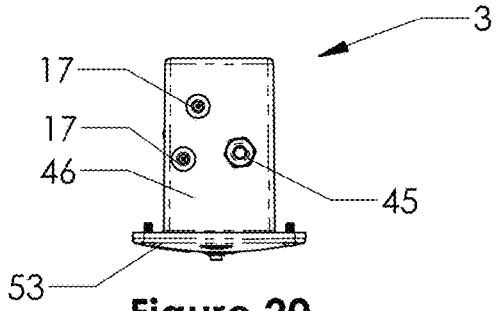
FIG. 20 is a Top view of the control module.
Figure 21:
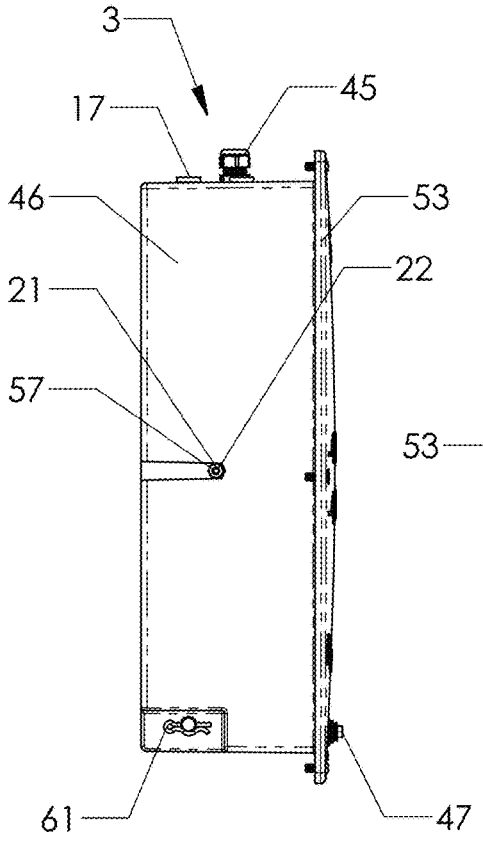
FIG. 21 is a Left side view of the control module.
Figure 22:
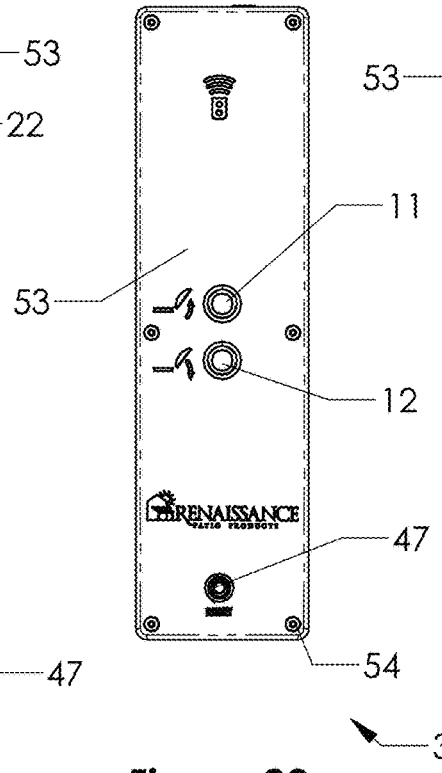
FIG. 22 is a Front view of the control module.
Figure 23:
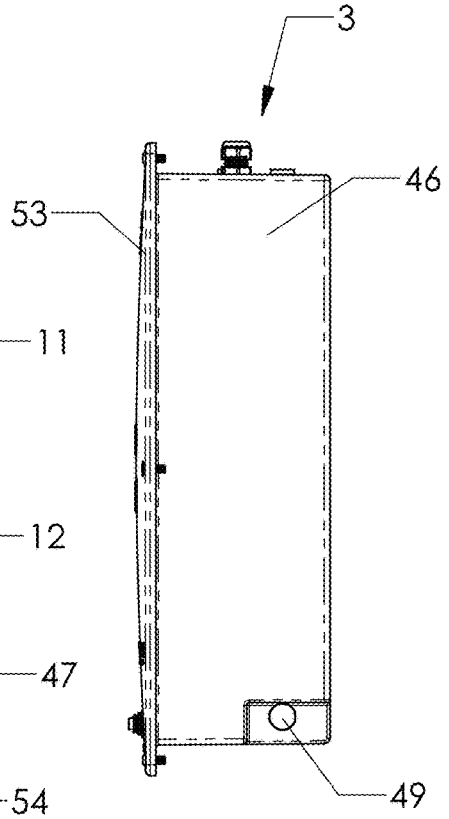
FIG. 23 is a Right side view of the control module.
Figure 24:
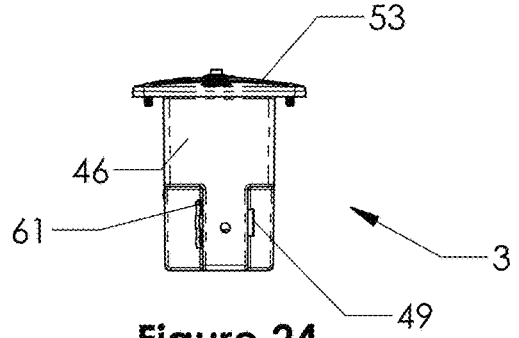
FIG. 24 is a Bottom view of the control module.
Figure 25:
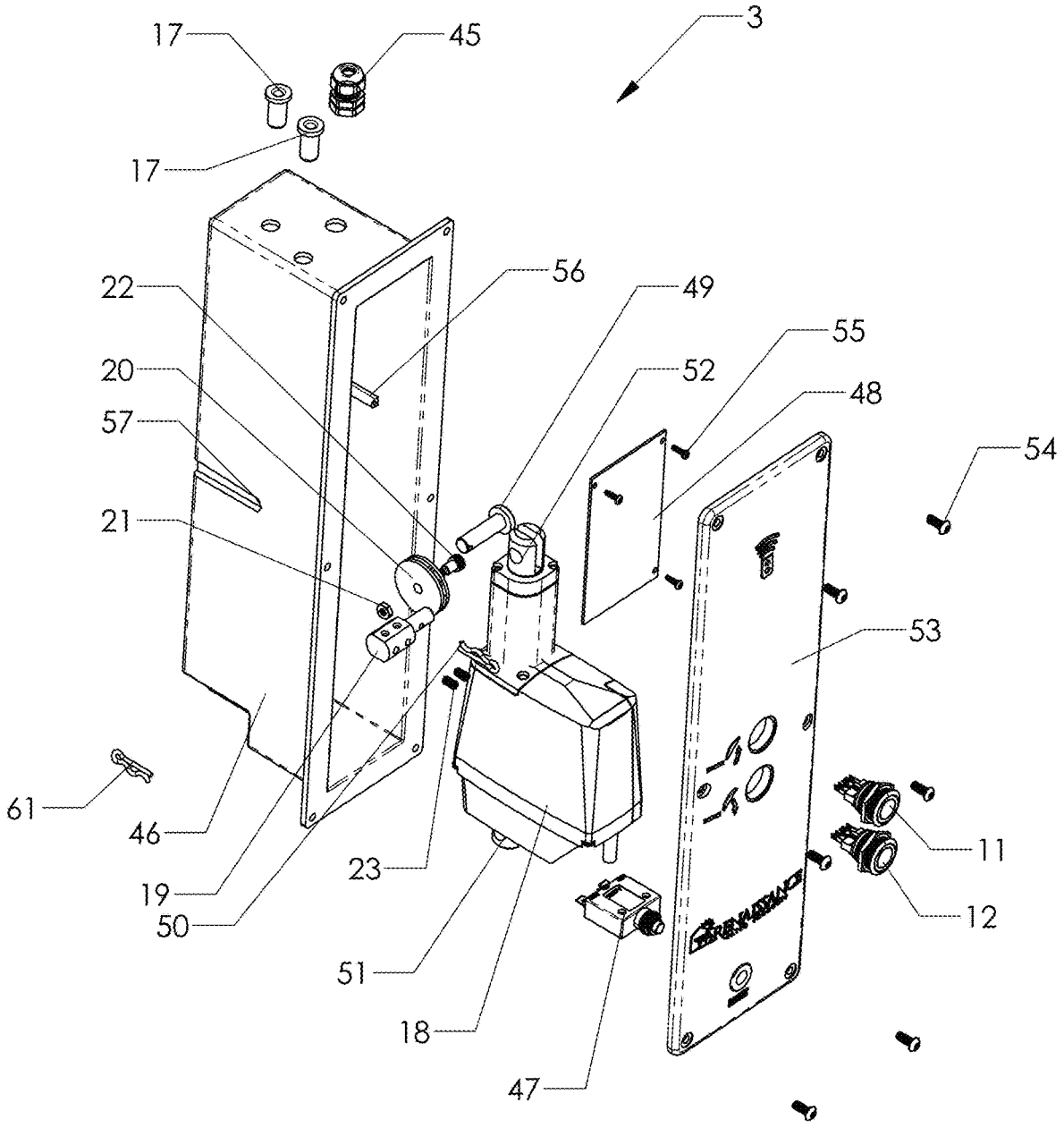
FIG. 25 is an Exploded isometric view of the control module.
Figure 26:
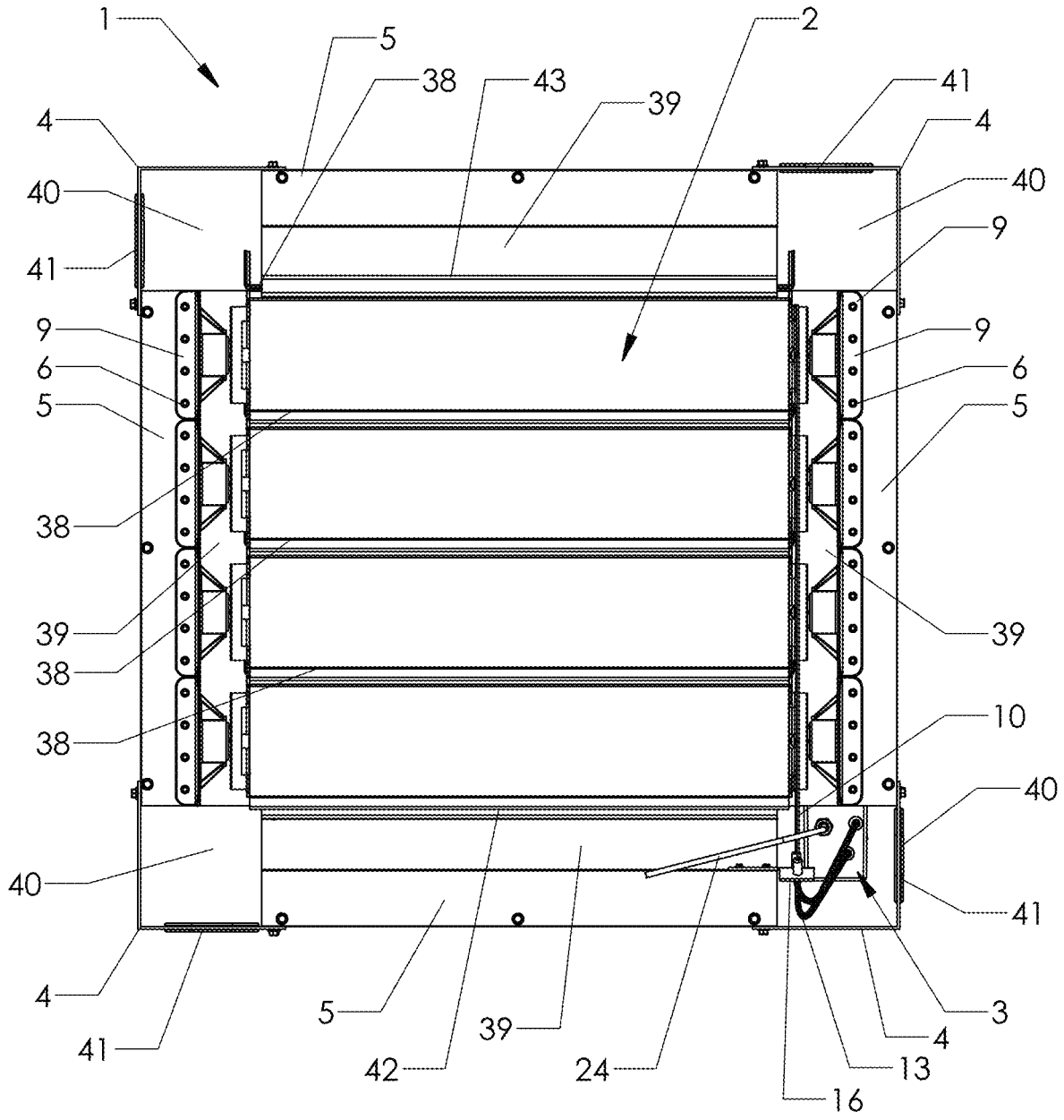
FIG. 26 is a Top view of the louver roof assemblies with parts removed for clarity.
Figure 27:
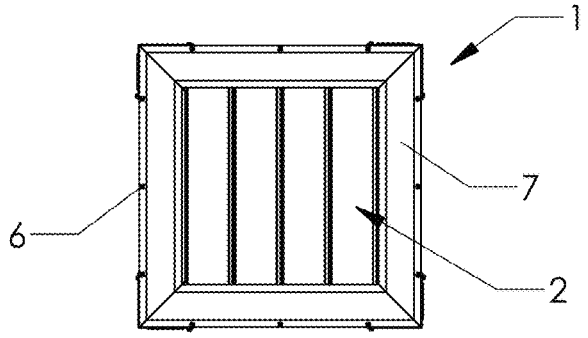
FIG. 27 is another Top view of the louver roof assemblies.
Figure 28:
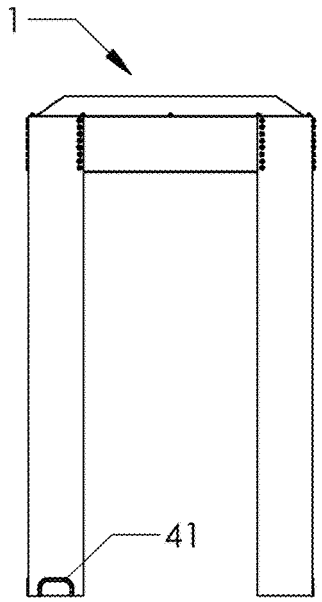
FIG. 28 is a Left view of the louver roof assemblies.
Figure 29:
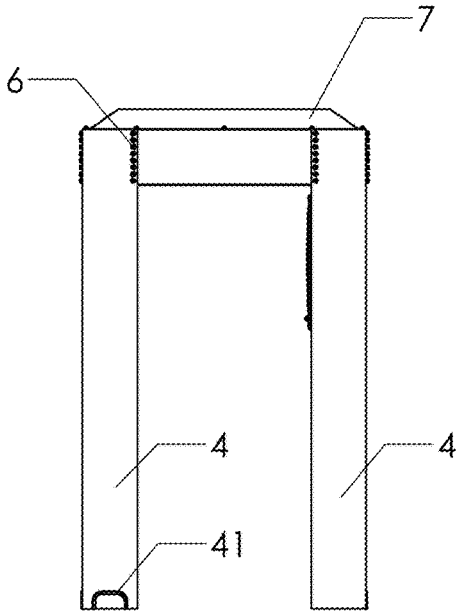
FIG. 29 is a Front view of the louver roof assemblies.
Figure 30:
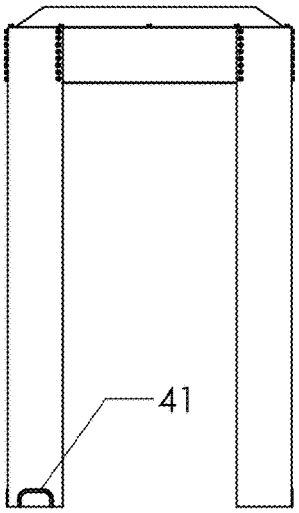
FIG. 30 is a Right view of the louver roof assemblies.
Figure 31:
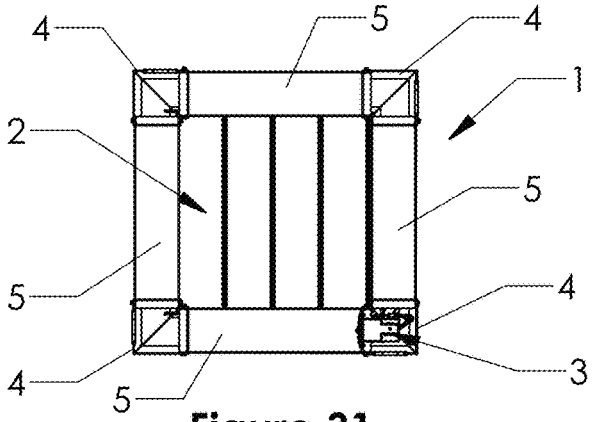
FIG. 31 is another Bottom view of the louver roof assemblies.

Referring to FIGS. 7 and 26, louver assembly 2 is captured and constrained in the main structure 1 by bearing 8, a part of louver assembly 2, inserted into the bearing receiver 59, an integral part of hanger 9. This bearing 8 and bearing receiver 59 design allows 15 degrees of angular freedom to allow slight misalignment between each end of the louver assembly 2 and allows the entire louver roof to be installed at an angle relative to beam 5 for water flow and/or aesthetics. Additionally or alternatively, the uppermost portion of the top surface of the louver body 32 of each of the louvers may define, when in the closed position, a non-perpendicular angle relative to the vertical direction such that water is directed to the water channel 38 of the respective louver, as shown, e.g., in FIG. 12. For instance, the first edge (e.g., the edge including sealing channel 37) may be positioned higher in the vertical direction than the channel edge (e.g., the edge including the water channel 38) in the closed position such that the louver body 32 defines the non-perpendicular angle. Thus, the uppermost portion of the top surface may then direct water that falls on the louver body 32 to the water channel 38 of the respective louver, rather than an adjacent louver. Additionally or alternatively, a vertical distance between the first edge and the channel edge of the uppermost portion of the top surface of the louver body 32 of each of the louvers may define a first height difference, when in the closed position (such as the position shown in FIG. 9). Furthermore and in the open position (such as in the position shown in FIG. 17), the vertical distance between the first edge and the channel edge of the top surface of the louver body 32 of each of the louvers may define a second height difference. Generally and as shown, the second height difference may be greater than the first height difference. Thus and in several exemplary embodiments, the vertical distance between the first edge (e.g., the edge including sealing channel 37) and the channel edge (e.g., the edge including the water channel 38) may increase as the louver and/or the louver assemblies 2 are moved from the closed position to the open position.

Figure 15:
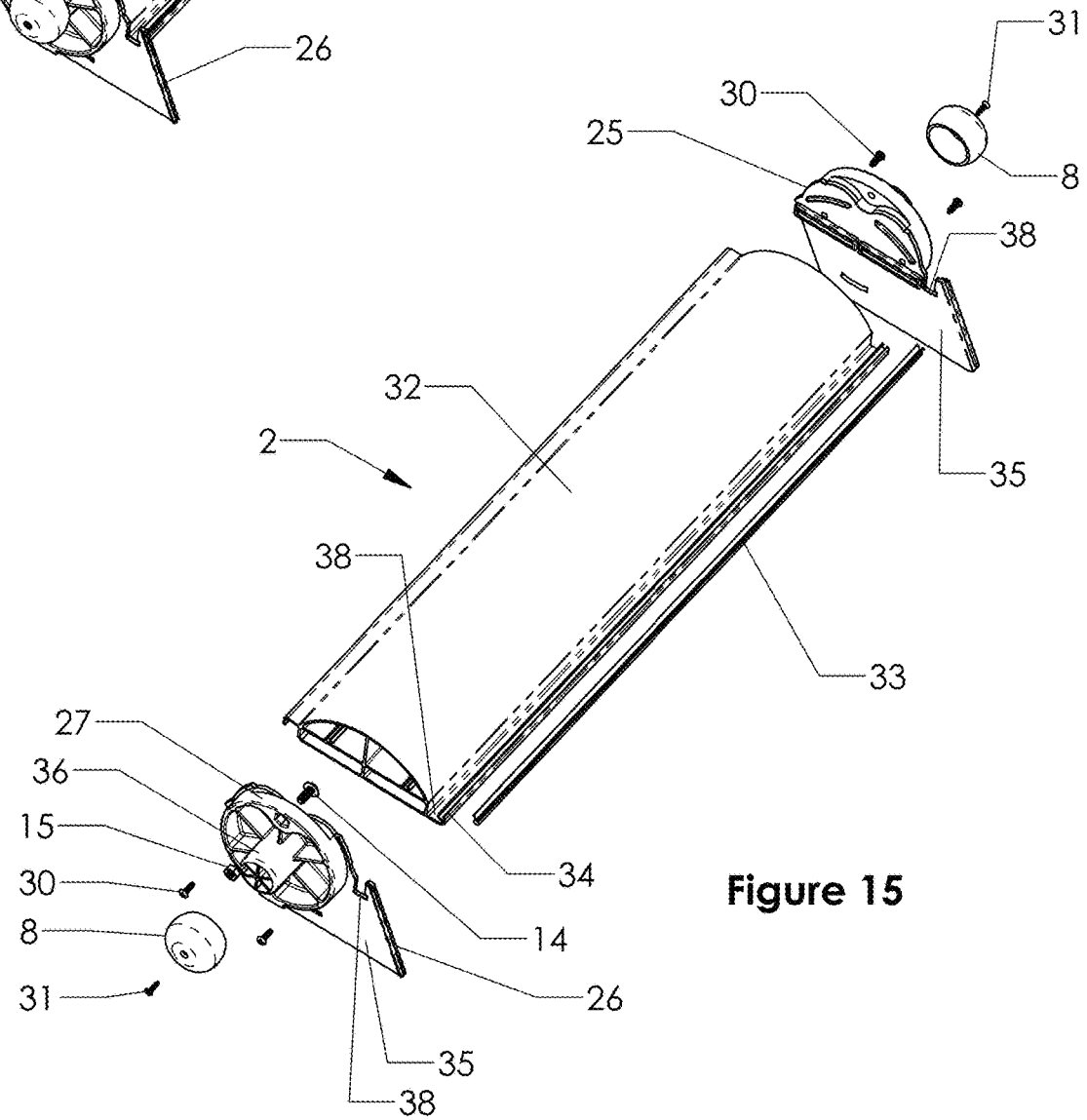
FIG. 15 is an Exploded isometric view of Louver assembly.

Referring now generally to FIGS. 4 and 8-19, the uppermost portion of the top surface of the louver body 32 of each of the louvers may define, when the louver assemblies 2 are in the closed position, a convex shape relative to the vertical direction from the first edge to the channel edge. For example and when viewing the louver body 32 in cross-section (e.g., as in FIG. 12), the uppermost portion of the top surface of louver body 32 may define the convex shape (e.g., a convex shape extending along the longitudinal direction and defined between the sealing channel 37 and the water channel 38, as depicted in FIG. 15). Additionally or alternatively, the uppermost portion of the top surface of the louver body 32 of each of the louvers may be, include, and/or define a semi-cylindrical shape. For instance and when viewed in cross-section, the louver body 32 of each louver may define the semi-cylindrical shape in a spanwise direction from the first edge to a channel edge. In some embodiment, an apex of the semi-cylindrical shaped uppermost portion of top surface defined by the louver body 32 of each of the louvers may be positioned mid-span between the first edge and the second edge. Additionally or alternatively, the uppermost portion of the top surface of the louver body 32 of each of the louvers may define a variable slope from the first edge to the channel edge, e.g., between the sealing channel 37 and the water channel 38 when viewed in cross-section.

In some embodiment and as shown particularly in FIGS. 4 and 12-15, the louver body 32 of each of the louvers may further include an inner channel wall extending longitudinally along the channel edge of the respective louver body 32. The inner channel wall may be configured to extend, when in the closed position, along the vertical direction between the channel edge of the uppermost portion of the top surface of the louver body 32 and a bottom of the integrally formed water channel 38 of the respective louver body 32. For instance, the inner channel wall may extend, when in the closed position, along the vertical direction from the channel edge of the uppermost portion of the top surface of the louver body 32 to a bottom of the integrally formed water channel 38 of the respective louver body 32.

Figure 9:
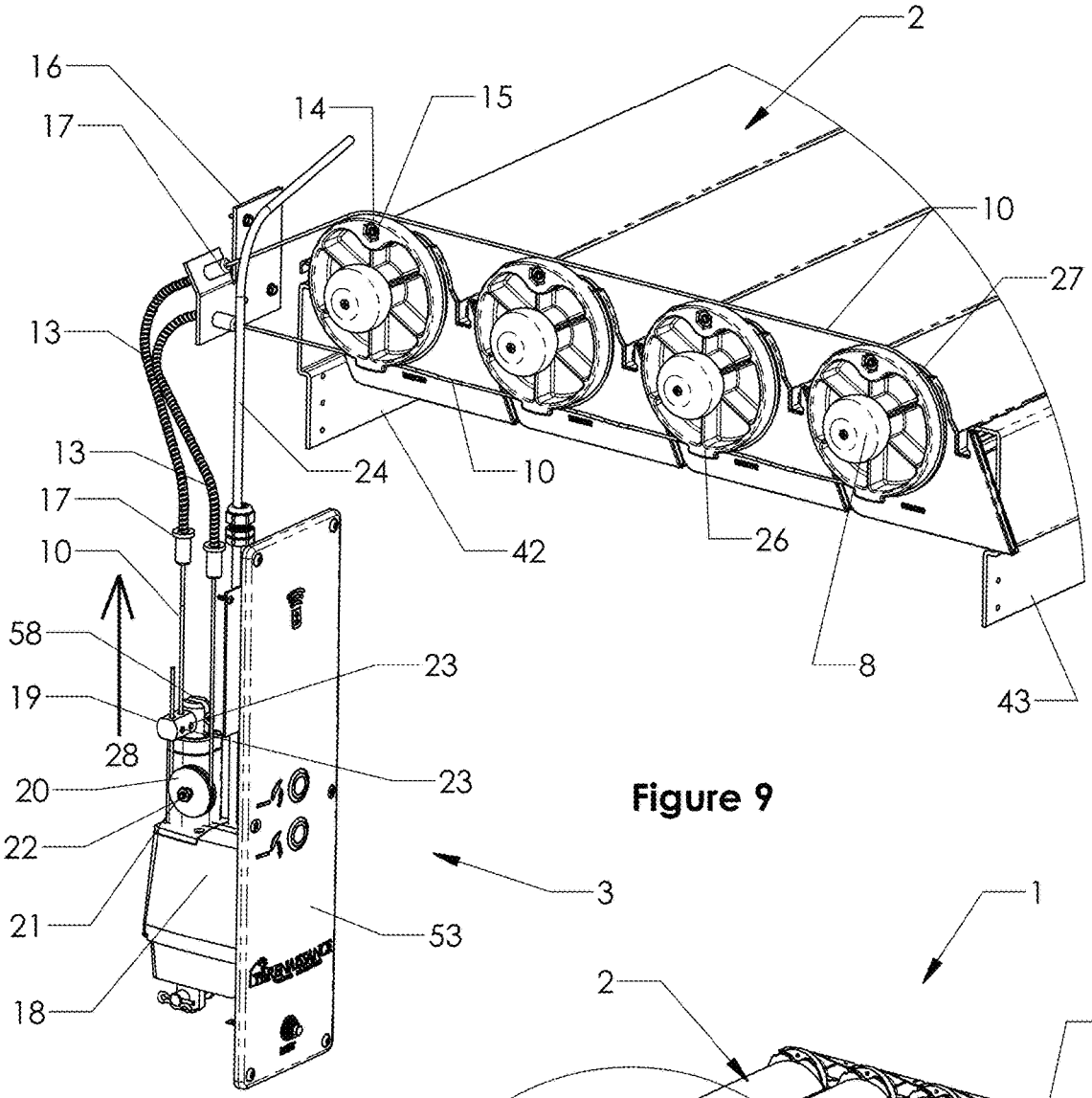
FIG. 9 is a magnified Detail view of FIG. 8.
Figure 8:
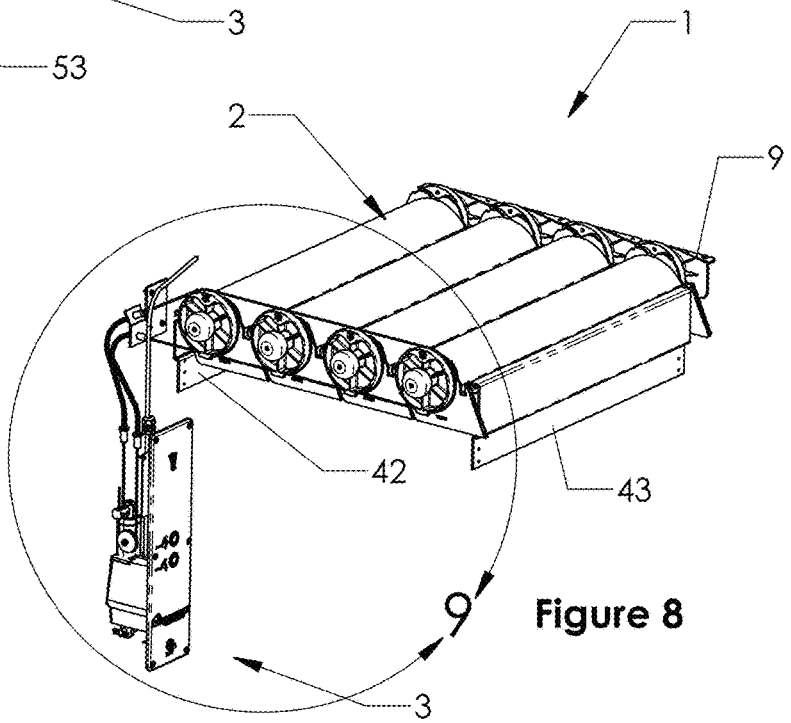
FIG. 8 is an Isometric view of the louver roof assemblies with parts removed for clarity.
Figure 10:
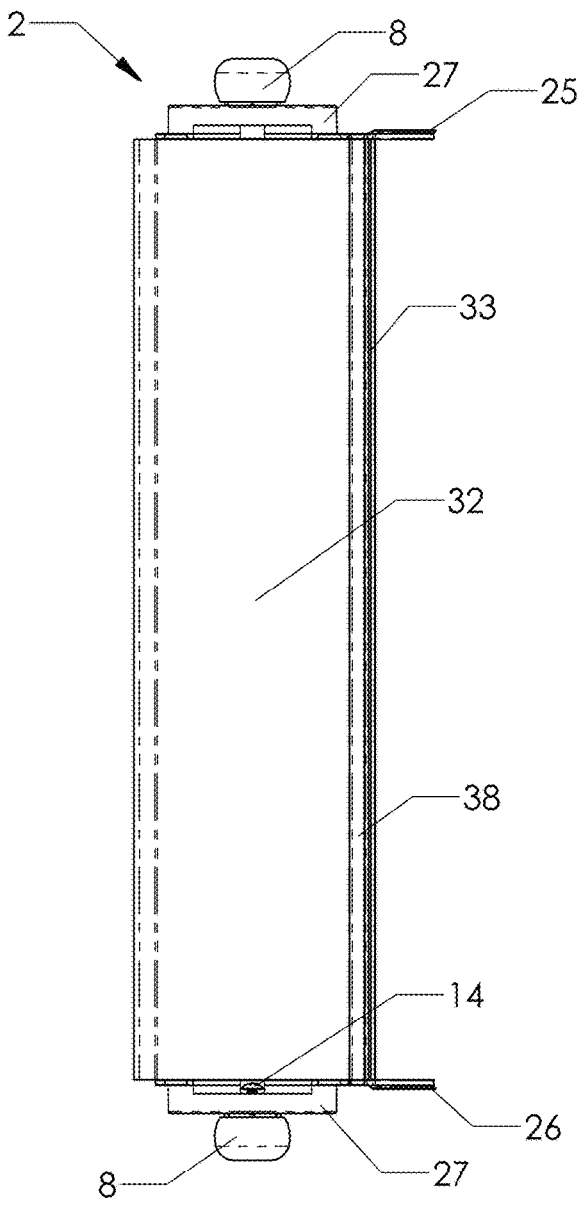
FIG. 10 is a Top view of the louver assembly.
Figure 11:
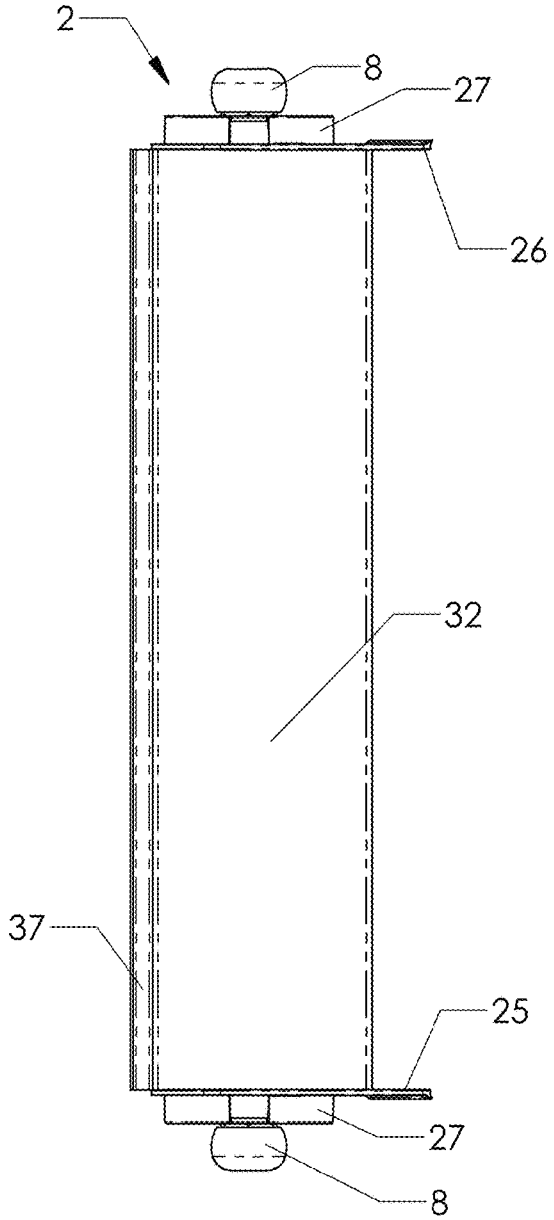
FIG. 11 is a Bottom view of the louver assembly.
Figure 12:
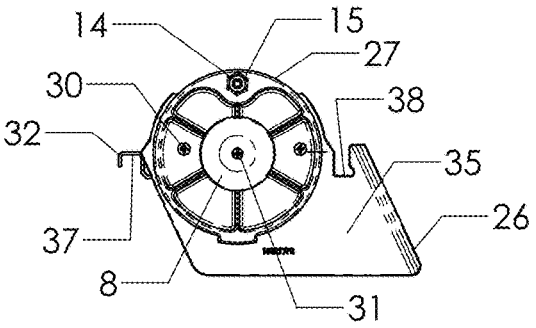
FIG. 12 is a Right view of the louver assembly.
Figure 13:
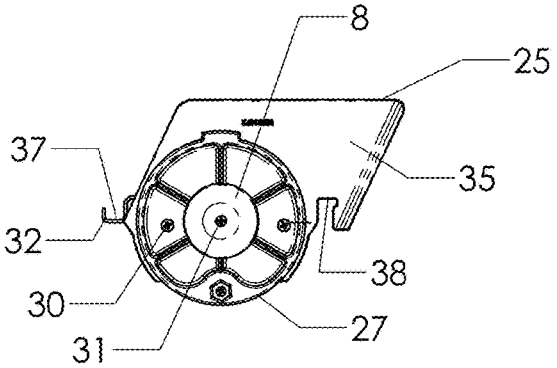
FIG. 13 is a Left view of the louver assembly.
Figure 14:
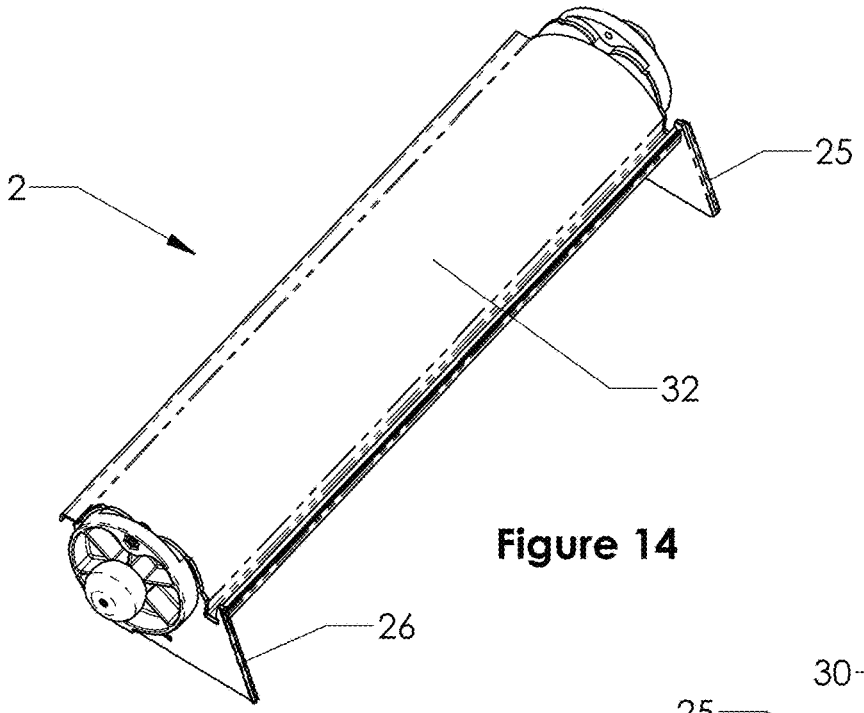
FIG. 14 is an Isometric view of the louver assembly.

Referring to FIGS. 8, 9, 15, 16, 17, 18, 19, 23 and 25, louver assemblies 2 are moved from the open to closed position by cable 10, a stainless-steel wire rope. Cable 10 is routed 1 (one) complete turn, around cable drum 27 and under the head of clamp screw 14 on each louver assembly. Cable drum 27 is an integral part of right end cap 26 a part of louver assembly 2. Each end of the cable is routed through sheath retainer 17 on cable retainer plate 16 and cable sheath 13. Cable retainer plate 16 is affixed to the adjacent beam 5. The cable 10 continues through the sheath retainer 17 on drive module 3. One end of the cable 10 is clamped into the cable return clamp 19 in the drive module 3 by means of a cable return clamp screw 23. The other end of the cable is looped around pulley 20 and is clamped into the cable return clamp 19 by means of the other cable return clamp screw 23. Pulley 20 is affixed to the actuator housing 46 by means of pulley retainer screw 22, located in pulley screw aperture 57 on actuator housing 46 and retained by pulley retainer nut 21. This creates a closed cable loop. Referring to FIG. 9, if the cable is pulled to rotate the louver assembly 2 clockwise, the louver is opened. If the cable is pulled opposite, the louver is closed. After the cable is securely fastened at the fully closed position, clamp screw 14 is tightened on each louver in the fully closed position.

To provide power to move the louvers, the cable return clamp 19 is connected to the plunger 58 side of linear actuator 18 by means of inserting cable return clamp 19 into actuator plunger aperture 52 on linear actuator 18 and retaining said clamp with clamp retainer 50. To mount and bias linear actuator 18 to the system, pin 49 placed through linear actuator mounting pin aperture 62 on actuator housing 46, through actuator mounting aperture 51 on linear actuator 18 and retained by pin retainer 61. As the plunger 58 moves in direction 28, the louvers are driven to the open position.

Power for linear actuator 18 is provided by power cable 24 entering the drive module 3 through a bulkhead cable seal 45 on actuator housing 46. Power is controlled and actuator direction is determined by an "H" bridge switch (not shown) on control printed wiring board 48. This board also contains a remote-control receiver and temperature sensor (not shown). Control printed wiring board 48 is mounted in actuator housing 46 by means of a plurality of control model screws 55 secured into control module bosses 56. The louvers can be controlled by radio remote control switch (not shown) or an open pushbutton switch 11 and a close pushbutton switch 12 located on control panel 53. Circuit breaker 47 is also located on control panel 53 as a safety feature. Control panel screws 54 secure the control panel 53 to actuator housing 46 and to one of the posts 4.

Referring to FIGS. 4, 4A, 8, 9, 12, 16, 17, 18, 19 and 26, to prevent water ingress from the open sides of the louvers, lower longitudinal splash shield 42 is affixed to beam 5 by means of a plurality self-tapping screws 6. Lower longitudinal splash shield seal 44 is press fit into seal channel 29, in integral part of lower longitudinal splash shield seal 44. This seal contacts sealing channel 37 when the louvers are in the closed position. On the opposite side of the lover roof, upper longitudinal splash shield 43 is attached to the opposite side beam 5 by means of a plurality of self-tapping screws 6. Louver seal 33 seals against upper longitudinal splash shield 43 when the louvers are in the closed position. Generally, the lower longitudinal splash shield 42 and/or the upper longitudinal splash shield 43 may be configured as a vertically oriented splash shield. For example, a vertically oriented splash shield may define a longitudinal length which extends along the longitudinal direction of the first sequential louver of the louver assemblies 2 and from a first end of the vertically oriented splash shield to a second end of the vertically oriented splash shield. The length of the vertically oriented splash shield may generally be the longest dimension of the vertically oriented splash shield, which may be longer than a height of the vertically oriented splash shield along the vertical direction, which may be greater than a thickness of the vertically oriented splash shield in a direction transverse to the longitudinal direction and the vertical direction.

In some embodiments, the louver body 32 of each of the louvers may define an arc between the first end and the second end thereof (e.g., along the longitudinal direction and in addition to or as an alternative to any arc or semi-cylindrical shape defined by the louver body 32 when viewed in cross-section). Additionally or alternatively, the vertically oriented splash shield (e.g., the lower longitudinal splash shield 42 and/or the upper longitudinal splash shield 43) may define an arc between the first end(s) of the vertically oriented splash shield and the second end(s) of the same. In additional or alternative embodiments, the vertically oriented splash shield(s) and the first sequential louver (and/or the last sequential louver, respectively) may be configured to selectively produce the seal therebetween along at least a portion of an arc defined by the respective first/last sequential louver and/or the vertically oriented splash shield(s). For example, the first sequential louver and/or the last sequential louver and associated longitudinal splash shield 42 and/or the upper longitudinal splash shield vertically oriented splash, and/or the associated louver seal(s) 33, 34 may define the same, similar, or complementary arcs such that the seal may be selectively produced along an entire length of the arc defined by first sequential louver (and/or along the entire length of the arc defined by the last sequential louver).

PARTS LIST

1 main structure
2 louver assembly
3 drive module
4 post(s) (vertically oriented posts)
5 beam(s) (crossbeams)
6 self-tapping screw
7 debris/UV cover
8 bearing
9 hanger
10 cable
11 open pushbutton switch
12 close pushbutton switch
13 cable sheath
14 clamp screw
15 clamp screw nut
16 cable retainer plate
17 sheath retainer
18 linear actuator
19 cable return clamp
20 pulley
21 pulley retainer nut
22 pulley retainer screw
23 cable return clamp screw
24 power cable
25 left louver cap
26 right louver cap
27 cable drum
28 open direction
29 seal channel
30 thread forming screw

31 screw
32 louver body
33 louver seal
34 louver seal channel
35 splash skirt
36 bearing boss
37 sealing channel
38 water channel
39 gutter(s) on inner portion of crossbeam(s)
40 downspout in post(s)
41 bezel
42 lower longitudinal splash shield
43 upper longitudinal splash shield
44 lower longitudinal splash shield seal
45 bulkhead cable seal
46 actuator housing
47 circuit breaker
48 control module
49 pin
50 clamp retainer
51 actuator mounting aperture
52 actuator plunger aperture
53 control panel
54 control panel screw
55 control module screw
56 control module boss
57 pulley screw aperture
58 plunger
59 bearing receiver
60 structural wall
61 pin retainer
62 linear actuator mounting pin aperture
63 aperture

What is claimed is:

1. A louver roof structure comprising:

a plurality of louvers positioned within an upper portion of a frame and that are actuatable from an open position to a closed position, wherein each louver of the plurality of louvers includes a louver body defining a channel configured to direct water internally from the louver body, through an interior of the respective louver, within the frame, and out of the louver roof structure; and the frame including:

vertically oriented posts, with each of the vertically oriented posts having a first end and a second end with the first end configured to directly contact a surface underneath the louver roof structure and support the louver roof structure thereon, a plurality of crossbeams, with at least one of the crossbeams positioned between and directly connected to the second end of two of the vertically oriented posts, the at least one crossbeam coupled to a cover, wherein:

the louver body of each of the louvers includes a top surface with an uppermost portion of the top surface that defines, when in the closed position, a non-perpendicular angle relative to the vertical direction such that water is directed to the integrally formed channel of the respective louver, and the frame includes internal portions configured to receive water from the plurality of channels formed by the plurality of louvers when in the closed position and direct water internally within the louver roof structure through the crossbeams of the frame internally into at least one of the vertically oriented posts of the frame, wherein the uppermost portion of the top surface of the louver body of each of the louvers is a semi-cylindrical shape, when viewed in cross-section, and extends along a longitudinal direction from a first end to a second end and extends along spanwise direction from a first edge to a channel edge.

2. The louver roof structure of claim 1, wherein the uppermost portion of the top surface of the louver body of each of the louvers extends from a first end to a second end between a first edge and channel edge, along which the integrally formed channel extends, and wherein the first edge is positioned higher in the vertical direction than the channel edge in the closed position such that the louver body defines the non-perpendicular angle.

3. The louver roof structure of claim 1, wherein the uppermost portion of the top surface of the louver body of each of the louvers defines, when in the closed position, a convex shape relative to the vertical direction from the first edge to the channel edge in cross-section.

4. The louver roof structure of claim 1, wherein an apex of the semi-cylindrical shaped uppermost portion of top surface defined by the louver body of each of the louvers is positioned mid-span between the first edge and the second edge.

5. The louver roof structure of claim 1, wherein the uppermost portion of the top surface of the louver body of each of the louvers defines a variable slope from the first edge to the channel edge in cross-section, and wherein the louver body of each of the louvers further includes an inner channel wall extending longitudinally along the channel edge of the respective louver body, the inner channel wall configured to extend, when in the closed position, along the vertical direction between the channel edge and a bottom of the integrally formed channel of the respective louver body.

6. The louver roof structure of claim 5, wherein the inner channel wall is further configured to extend, when in the closed position, along the vertical direction from the channel edge to a bottom of the integrally formed channel of the respective louver body.

7. The louver roof structure of claim 1, wherein a vertical distance between the first edge and the channel edge of the uppermost portion of the top surface of the louver body of each of the louvers defines a first height difference, when in the closed position, and wherein, in the open position, the vertical distance between the first edge and the channel edge of the top surface of the louver body of each of the louvers defines a second height difference, the second height difference greater than the first height difference.

8. The louver roof structure of claim 1, wherein the louver body of each of the louvers extends along a longitudinal direction from a first end to a second end, and wherein the louver body of each of the louvers defines an arc between the first end and the second end.

9. The louver roof structure of claim 8, wherein the louver body of each of the louvers defines an arc from the first end of the louver to the second end.

10. The louver roof structure of claim 1, wherein each of the louvers extends along a longitudinal direction from a first end to a second end, and wherein each of the louvers includes a cable drum coupled to the first end.

11. The louver roof structure of claim 10, wherein each of the louvers further includes an end cap integrally formed with the cable drum.

12. The louver roof structure of claim 1, wherein the frame further comprises:

a vertically oriented splash shield affixed to one of the crossbeams and extending along the longitudinal axis of a first sequential louver of the plurality of louvers, wherein the vertically oriented splash shield and the first sequential louver are configured to selectively produce a seal therebetween when the first sequential louver is in the closed position.

13. A louver roof structure assembly comprising:

a plurality of louvers configured for positioning within an upper portion of a frame that move from an open position to a closed position, the plurality of louvers form a plurality of channels configured to direct water internally within the frame and out of the louver roof structure when the plurality of louvers are in the closed position; and the frame including:

vertically oriented posts, with each of the vertically oriented posts having a first end and a second end with the first end configured to directly contact a surface underneath the louver roof structure and support the louver roof structure thereon, a plurality of crossbeams, with each of the crossbeams configured for positioning between and directly connected to the second end of two vertically oriented posts, each of the crossbeams coupled to a cover, and a vertically oriented splash shield affixed to one of the crossbeams and extending along a longitudinal axis of a first sequential louver of the plurality of louvers, wherein the vertically oriented splash shield and the first sequential louver are configured to selectively produce a seal therebetween when the first sequential louver is in the closed position, and wherein the frame includes internal portions configured to receive water from the plurality of channels formed by the plurality of louvers when in the closed position and direct water internally within the louver roof structure through at least one of the crossbeams of the frame internally into at least one of the vertically oriented posts of the frame.

14. The louver roof structure assembly of claim 13, wherein the frame further comprises:

an additional vertically oriented splash shield affixed to another one of the crossbeams and extending along a longitudinal axis of a last sequential louver of the plurality of louvers, wherein the additional vertically oriented splash shield and the last sequential louver are configured to selectively produce an additional seal therebetween when the last sequential louver is in the closed position.

15. The louver roof structure assembly of claim 13, wherein the vertically oriented splash shield extends along the longitudinal direction of the first sequential louver of the plurality of louvers and from a first end of the vertically oriented splash shield to a second end, and wherein the vertically oriented splash shield defines an arc between the first end and the second end.

16. The louver roof structure assembly of claim 15, wherein the first sequential louver of the plurality of louvers extends along the longitudinal direction from a first end to a second end and defines an arc between the first end and the second end.

17. The louver roof structure assembly of claim 16, wherein the vertically oriented splash shield and the first sequential louver are configured to selectively produce the seal therebetween along an entire length of the arc defined by first sequential louver.

* * * * *